US011551616B2

(12) United States Patent
Park

(10) Patent No.: US 11,551,616 B2
(45) Date of Patent: Jan. 10, 2023

(54) STAGE AND SCAN DRIVER INCLUDING THE SAME

(71) Applicant: SAMSUNG DISPLAY CO., LTD., Yongin-si (KR)

(72) Inventor: Kyung Ho Park, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/478,379

(22) Filed: Sep. 17, 2021

(65) Prior Publication Data

US 2022/0005415 A1 Jan. 6, 2022

Related U.S. Application Data

(63) Continuation of application No. 16/860,935, filed on Apr. 28, 2020, now Pat. No. 11,151,940.

(30) Foreign Application Priority Data

May 2, 2019 (KR) ..... 10-2019-0051691

(51) Int. Cl.

| | |
|---|---|
| ***G09G 3/3258*** | (2016.01) |
| ***G09G 3/3266*** | (2016.01) |
| ***G09G 3/3275*** | (2016.01) |

(52) U.S. Cl.

CPC ..... *G09G 3/3258* (2013.01); *G09G 3/3266* (2013.01); *G09G 3/3275* (2013.01); *G09G 2310/0291* (2013.01); *G09G 2310/08* (2013.01); *G09G 2320/04* (2013.01)

(58) Field of Classification Search

CPC .. G09G 3/3258; G09G 3/3266; G09G 3/3275; G09G 2310/0291; G09G 2310/08; G09G 2320/04

See application file for complete search history.

(56) References Cited

U.S. PATENT DOCUMENTS

| | | | |
|---|---|---|---|
| 8,654,158 | B2 | 2/2014 | Tsai et al. |
| 8,957,882 | B2 | 2/2015 | Lee et al. |
| 9,576,543 | B2 | 2/2017 | He |
| 10,079,598 | B2 | 9/2018 | Park et al. |
| 10,127,874 | B2 | 11/2018 | Park et al. |
| 2016/0322116 | A1 | 11/2016 | Jang et al. |
| 2018/0337682 | A1 | 11/2018 | Takasugi et al. |
| 2019/0164498 | A1 | 5/2019 | Jang |

(Continued)

FOREIGN PATENT DOCUMENTS

| | | |
|---|---|---|
| KR | 10-2016-0073928 | 6/2016 |
| KR | 10-2016-0117709 | 10/2016 |

(Continued)

*Primary Examiner* — Michael Pervan

(74) *Attorney, Agent, or Firm* — F. Chau & Associates, LLC

(57) ABSTRACT

A stage connected to scan lines and supplying a scan signal and a sensing signal to the scan lines includes an input unit and an output buffer. The input unit controls a voltage of a first node and a second node in response to a first control signal and a previous carry signal, where an eleventh node and a twelfth node are electrically connected to the first node and the second node, respectively, in response to a second control signal. The output buffer outputs a carry signal and the scan signal in response to a scan clock signal according to a voltage of the eleventh node and the twelfth node and outputs the sensing signal in response to a sensing clock signal.

10 Claims, 6 Drawing Sheets

(56) References Cited

U.S. PATENT DOCUMENTS

| | | | |
|---|---|---|---|
| 2020/0066203 | A1 | 2/2020 | Kim |
| 2020/0219451 | A1 | 7/2020 | Kim |
| 2020/0243018 | A1 | 7/2020 | Kim et al. |
| 2020/0349888 | A1 | 11/2020 | Park |
| 2020/0410943 | A1 | 12/2020 | Kim |

FOREIGN PATENT DOCUMENTS

| | | |
|---|---|---|
| KR | 10-2016-0127211 | 11/2016 |
| KR | 10-1860732 | 5/2018 |
| KR | 10-2018-0128123 | 12/2018 |
| KR | 10-2019-0009216 | 1/2019 |
| KR | 10-2020-0023563 | 3/2020 |
| KR | 10-2020-0085976 | 7/2020 |
| KR | 10-2020-0094895 | 8/2020 |

STAGE AND SCAN DRIVER INCLUDING THE SAME

CROSS-REFERENCE TO RELATED APPLICATION

The present application is a continuation application of U.S. patent application Ser. No. 16/860,935 filed Apr. 28, 2020, which claims priority under 35 U.S.C. § 119 to Korean Patent Application No. 10-2019-0051691, filed in the Korean Intellectual Property Office on May 2, 2019, the disclosures of which are incorporated by reference herein in their entirety.

TECHNICAL FIELD

Exemplary embodiments of the inventive concept relate to a stage and a scan driver including the same.

DISCUSSION OF RELATED ART

A display device includes a pixel unit including a plurality of pixels, a scan driver, a data driver, and a timing controller. The scan driver includes stages connected to scan lines, and the stages supply a scan signal to the scan line connected to the stages in response to signals from the timing controller.

Recently, display devices have been operated to compensate for a degradation or characteristic change of a driving transistor outside a pixel circuit by sensing a threshold voltage or mobility of the driving transistor included in the pixel circuit. For this purpose, the scan driver may be configured to further supply a sensing signal through a sensing line.

The scan driver receives a clock signal for controlling a carry signal output, a clock signal for controlling a scan signal output, and a clock signal for controlling a sensing signal output. When separate lines are provided on a display panel to supply the clock signals individually, a bezel area of the display device is increased.

SUMMARY

According to an exemplary embodiment of the inventive concept, a stage connected to scan lines and supplying a scan signal and a sensing signal to the scan lines includes an input unit and an output buffer. The input unit controls a voltage of a first node and a second node in response to a first control signal and a previous carry signal, where an eleventh node and a twelfth node are electrically connected to the first node and the second node, respectively, in response to a second control signal. The output buffer outputs a carry signal and the scan signal in response to a scan clock signal according to a voltage of the eleventh node and the twelfth node and outputs the sensing signal in response to a sensing clock signal.

In addition, the second control signal may be input to the output buffer during a sensing period in a frame.

In addition, the scan clock signal and the sensing clock signal may be input to the output buffer at least once while the second control signal is input during the sensing period.

In addition, the output buffer may include a twelfth transistor connected between a scan clock terminal receiving the scan clock signal and a carry output terminal outputting the carry signal, and including a gate electrode connected to the eleventh node, and a twenty-ninth transistor connected between the carry output terminal and a first power terminal receiving a first power, and including a gate electrode connected to a second input terminal receiving the second control signal.

In addition, the twenty-ninth transistor may be turned on by the second control signal during the sensing period to supply a voltage of the first power to the carry output terminal.

In addition, the output buffer may further include a twenty-sixth transistor connected between the first node and the eleventh node and including a gate electrode connected to the second input terminal, and a twenty-seventh transistor connected between the second node and the twelfth node and including a gate electrode connected to the second input terminal. The twenty-sixth transistor and the twenty-seventh transistor may be turned on by the second control signal to electrically connect the eleventh node and the twelfth node to the first node and the second node, respectively.

In addition, the output buffer may receive a seventh control signal during the sensing period in the frame, and the scan clock signal and the sensing clock signal may be input to the output buffer at least once while the seventh control signal is input during the sensing period.

In addition, the input unit may include a twenty-first transistor connected between a second carry input terminal receiving the previous carry signal and a third node, and including a gate electrode connected to a first input terminal receiving the first control signal, a twenty-second transistor connected between the third node and a fourth power terminal receiving a fourth power, and including a gate electrode connected to a fourth node, a twenty-third transistor connected between the third node and the fourth node, and including a gate electrode connected to the first input terminal, a twenty-fourth transistor connected between the fourth power terminal and the first node, and including a gate electrode connected to the fourth node, a twenty-fifth transistor connected between the second node and a first power terminal receiving a first power, and including a gate electrode connected to the fourth node, and a capacitor connected between the fourth power terminal and the fourth node.

In addition, the twenty-first transistor, the twenty-second transistor, and the twenty-third transistor may be turned on when the first control signal is input to supply a voltage of the previous carry signal to the fourth node.

In addition, the twenty-fourth transistor may be turned on in response to a voltage of the fourth node to supply a voltage of the fourth power to the first node, and the twenty-fifth transistor may be turned on in response to a voltage of the fourth node to supply a voltage of the low-potential power to the second node.

According to an exemplary embodiment of the inventive concept, a scan driver includes a plurality of stages connected to scan lines and supplying a scan signal and a sensing signal to the scan lines. An i-th stage (where i is a natural number) includes an input unit and an output buffer. The input unit controls a voltage of a first node and a second node in response to a first control signal and a previous carry signal, where an eleventh node and a twelfth node are electrically connected to the first node and the second node, respectively, in response to a second control signal. The output buffer outputs a carry signal and the scan signal in response to a scan clock signal according to a voltage of the eleventh node and the twelfth node and outputs the sensing signal in response to a sensing clock signal.

In addition, the second control signal may be input to the output buffer during a sensing period in a frame.

In addition, the scan clock signal and the sensing clock signal may be input to the output buffer at least once while the second control signal is input during the sensing period.

In addition, the output buffer may include a twelfth transistor connected between a scan clock terminal receiving the scan clock signal and a carry output terminal outputting the carry signal, and including a gate electrode connected to the eleventh node, and a twenty-ninth transistor connected between the carry output terminal and a first power terminal receiving a first power, and including a gate electrode connected to a second input terminal receiving the second control signal.

In addition, the twenty-ninth transistor may be turned on by the second control signal during the sensing period to supply a voltage of the first power to the carry output terminal.

In addition, the output buffer may further include a twenty-sixth transistor connected between the first node and the eleventh node and including a gate electrode connected to the second input terminal, and a twenty-seventh transistor connected between the second node and the twelfth node and including a gate electrode connected to the second input terminal. The twenty-sixth transistor and the twenty-seventh transistor may be turned on by the second control signal to electrically connect the eleventh node and the twelfth node to the first node and the second node, respectively.

In addition, the output buffer may receive a seventh control signal during the sensing period in the frame, and the scan clock signal and the sensing clock signal may be input to the output buffer at least once while the seventh control signal is input during the sensing period.

In addition, the input unit may include a twenty-first transistor connected between a second carry input terminal receiving the previous carry signal and a third node, and including a gate electrode connected to a first input terminal receiving the first control signal, a twenty-second transistor connected between the third node and a fourth power terminal receiving a fourth power, and including a gate electrode connected to a fourth node, a twenty-third transistor connected between the third node and the fourth node, and including a gate electrode connected to the first input terminal, a twenty-fourth transistor connected between the fourth power terminal and the first node, and including a gate electrode connected to the fourth node, a twenty-fifth transistor connected between the second node and a first power terminal receiving a first power, and including a gate electrode connected to the fourth node, and a capacitor connected between the fourth power terminal and the fourth node.

In addition, the twenty-first transistor, the twenty-second transistor, and the twenty-third transistor may be turned on when the first control signal is input to supply a voltage of the previous carry signal to the fourth node.

In addition, the twenty-fourth transistor may be turned on in response to a voltage of the fourth node to supply a voltage of the fourth power to the first node, and the twenty-fifth transistor may be turned on in response to a voltage of the fourth node to supply a voltage of the first power to the second node.

According to an exemplary embodiment of the inventive concept, a scan driver includes first and second stages disposed adjacent to each other, and a power line disposed between the first and second stages. Each of the first and second stages includes an input unit connected to a first node and a second node, and an output buffer including a first transistor configured to connect the first node to a third node in response to a control signal, and a second transistor configured to connect the second node to a fourth node in response to the control signal. The output buffer outputs a scan clock signal as a carry signal in response to a voltage of the third node, outputs a sensing clock signal as a sensing signal in response to the voltage of the third node, and outputs the scan clock signal as a scan signal in response to the voltage of the third node. The first and second stages share the power line.

BRIEF DESCRIPTION OF THE DRAWINGS

The above and other features of the inventive concept will become more apparent by describing in detail exemplary embodiments thereof with reference to the accompanying drawings.

DETAILED DESCRIPTION OF THE EMBODIMENTS

Figure 1:
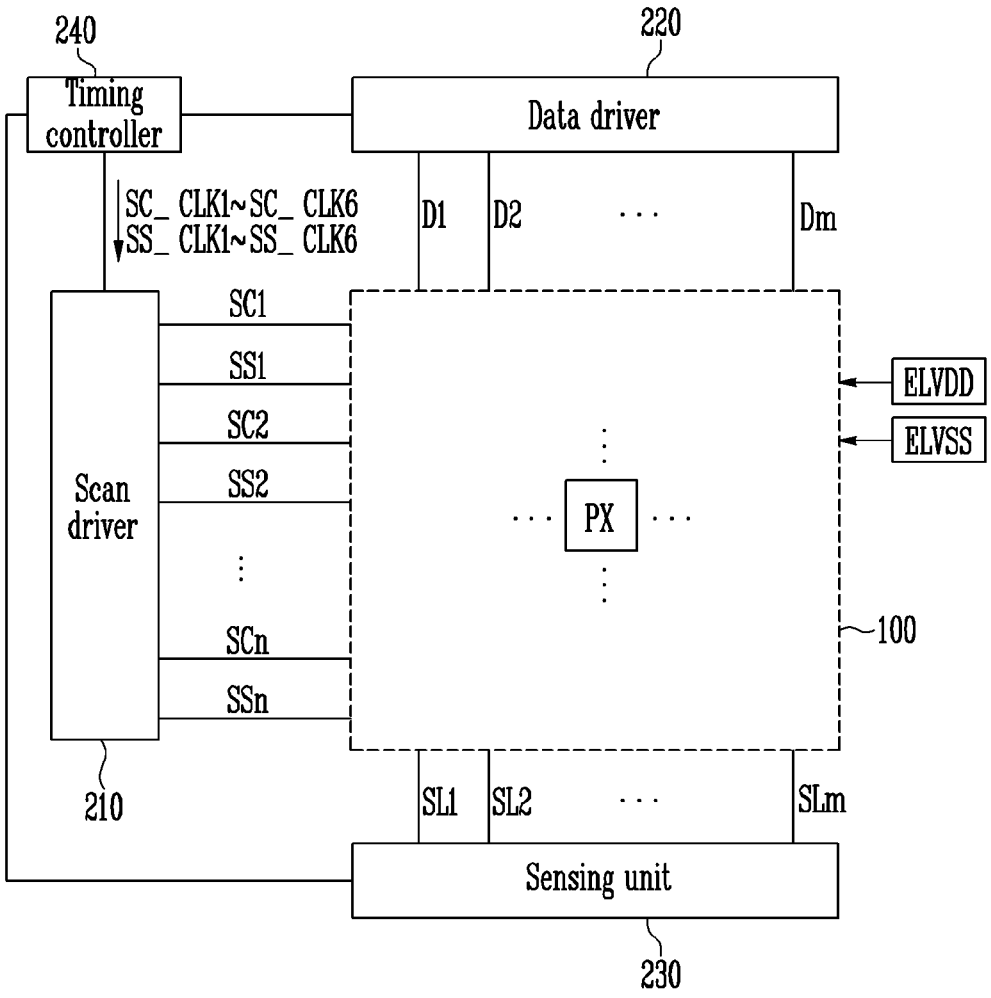
FIG. 1 is a block diagram showing a display device according to an exemplary embodiment of the inventive concept.

Exemplary embodiments of the inventive concept provide a stage configured to share a clock signal for controlling a carry signal output and a clock signal for controlling a scan signal output, and a scan driver including the same.

Exemplary embodiments of the inventive concept also provide a stage for receiving a scan clock signal and a sensing clock signal, and for outputting a carry signal, a scan signal, and a sensing signal, and a scan driver including the same.

Exemplary embodiments of the inventive concept will be described more fully hereinafter with reference to the accompanying drawings. Like reference numerals may refer to like elements throughout this application.

In the following description, when one part is referred to as being 'connected' to another part, it should be understood that the former may be 'directly connected' to the latter, or 'electrically connected' to the latter via an intervening part.

FIG. 1 is a block diagram showing a display device according to an exemplary embodiment of the inventive concept.

Referring to FIG. 1, a display device according to an exemplary embodiment of the inventive concept may include a display unit 100 including a plurality of pixels PX, a scan driver 210, a data driver 220, a sensing unit 230, and a timing controller 240.

The timing controller 240 may generate a scan driving control signal and a data driving control signal based on signals input from an external source. The scan driving control signal generated from the timing controller 240 may be supplied to the scan driver 210, and the data driving control signal may be supplied to the data driver 220.

The scan driving control signal may include a plurality of clock signals SC_CLK1 to SC_CLK6 and SS_CLK1 to SS_CLK6, and a scan start signal. The scan start signal may control an output timing of a first scan signal.

The plurality of clock signals SC_CLK1 to SC_CLK6 and SS_CLK1 to SS_CLK6 supplied to the scan driver 210 may include first to sixth scan clock signals SC_CLK1 to SC_CLK6 and first to sixth sensing clock signals SS_CLK1 to SS_CLK6. The first to sixth scan clock signals SC_CLK1 to SC_CLK6 may be used to shift the scan start signal. In addition, the first to sixth scan clock signals SC_CLK1 to SC_CLK6 may be used to output a scan signal in response to the scan start signal. The first to sixth sensing clock signals SS_CLK1 to SS_CLK6 may be used to output a sensing signal in response to the scan start signal. In addition, the scan driver 210 may further receive clock signals in addition to the above-described clock signals SC_CLK1 to SC_CLK6 and SS_CLK1 to SS_CLK6.

The data driving control signal may include source start pulse and clock signals. The source start pulse may control a sampling start point of data, and the clock signals may be used to control a sampling operation.

The scan driver 210 may output scan signals in response to the scan driving control signal. The scan driver 210 may sequentially supply the scan signals to first scan lines SC1 to SCn. Here, the scan signals may be set to a gate-on voltage (e.g., a high level voltage) so that transistors included in the pixel PX may be turned on.

The scan driver 210 may output a sensing signal in response to the scan driving control signal. The scan driver 210 may supply the sensing signal to at least one of second scan lines SS1 to SSn. Here, the sensing signal may be set to a gate-on voltage (e.g., a high level voltage) so that a transistor included in the pixel PX may be turned on.

The data driver 220 may supply data signals to data lines D1 to Dm in response to the data driving control signal. The data signals supplied to the data lines D1 to Dm may be supplied to the pixels PX to which the scan signals are supplied. For this purpose, the data driver 220 may supply the data signals to the data lines D1 to Dm to synchronize with the scan signals.

The sensing unit 230 may measure degradation information of the pixels PX based on a current and/or voltage fed back through sensing lines SL1 to SLm. Here, the pixels PX, in which the degradation information is measured through the sensing unit 230, may be pixels PX of a pixel column to which the sensing signal is supplied.

The degradation information may be a characteristic of a driving transistor included in a pixel PX, and may include threshold voltage and mobility information of the driving transistor. In addition, the degradation information may include information on a characteristic of a light emitting element included in the pixel PX. The sensing unit 230 is shown as being a separate component in FIG. 1, but the sensing unit 230 may be included in the data driver 220.

The plurality of pixels PX may be connected to the data lines D1 to Dm, the first scan lines SC1 to SCn, the second scan lines SS1 to SSn, and the sensing lines SL1 to SLm.

The pixels PX may receive a first power ELVDD and a second power ELVSS from the outside.

Each of the pixels PX may receive a data signal from the data lines D1 to Dm when a scan signal is supplied to a corresponding one of the first scan lines SC1 to SCn during a display period. The pixel PX receiving the data signal may control an amount of current flowing from the first power ELVDD to the second power ELVSS via a light emitting element in response to the data signal. At this time, the light emitting element may generate light of a predetermined luminance in response to the amount of current. The first power ELVDD may be set to a higher voltage than the second power ELVSS.

In addition, each of the pixels PX may output a current and/or voltage to the sensing lines SL1 to SLm based on the data signal supplied to the data lines D1 to Dm when the sensing signal is supplied to a corresponding one of the second scan lines SS1 to SSn during a sensing period. During the sensing period, the data signal supplied to the data lines D1 to Dm may be a certain reference data signal for sensing the pixel PX.

The plurality of first scan lines SC1 to SCn may be connected to the pixel PX corresponding to a circuit structure of the pixels PX. In addition, in some cases, the pixels PX may be connected to a light emission control line other than the first scan lines SC1 to SCn and the data lines D1 to Dm. In this case, a light emission driver for outputting a light emission control signal may be further provided.

Figure 2:
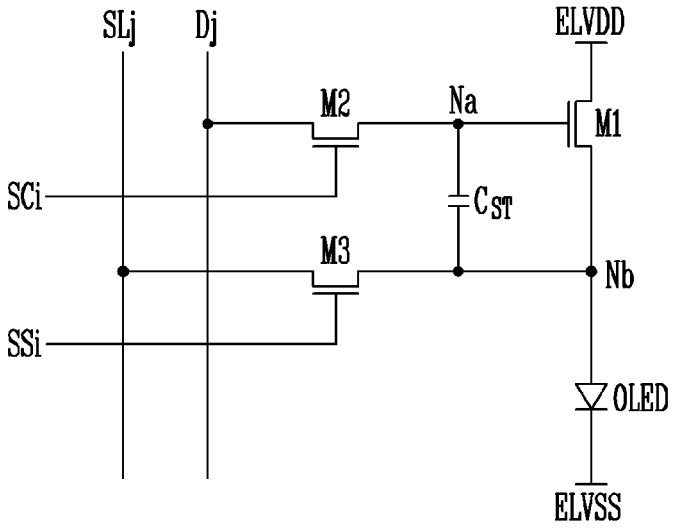
FIG. 2 is a circuit diagram showing a pixel included in the display device shown in FIG. 1 according to an exemplary embodiment of the inventive concept.

FIG. 2 is a circuit diagram showing a pixel included in the display device shown in FIG. 1 according to an exemplary embodiment of the inventive concept. FIG. 2 shows the pixel PX connected to an i-th first scan line SCi, an i-th second scan line SSi, a j-th sense line SLj, and a j-th data line Dj, where i and j are natural numbers.

The pixel PX may include a driving transistor M1, a switching transistor M2, a sensing transistor M3, and a storage capacitor Cst, and a light emitting element OLED.

The switching transistor M2 may include a first electrode connected to the j-th data line Dj, a gate electrode connected to the i-th first scan line SCi, and a second electrode connected to a first node Na.

The switching transistor M2 may be turned on when the scan signal is supplied from the i-th first scan line SCi, and may supply the data signal received from the j-th data line Dj to the storage capacitor Cst. Alternatively, the switching transistor M2 may control a potential of the first node Na.

At this time, the storage capacitor Cst including a first electrode connected to the first node Na and a second electrode connected to a second node Nb may charge a voltage corresponding to the data signal.

The driving transistor M1 may include a first electrode connected to the first power ELVDD, a second electrode connected to the light emitting element OLED, and a gate electrode connected to the first node Na.

The driving transistor M1 may control the amount of current flowing in the light emitting element OLED corresponding to a voltage between the gate electrode and a source electrode (e.g., the first electrode).

The sensing transistor M3 may include a first electrode connected to the j-th sensing line SLj, a second electrode connected to the second node Nb, and a gate electrode connected to the i-th second scan line SSi. The sensing transistor M3 may be turned on when the sensing signal is supplied to the i-th second scan line SSi to control a potential of the second node Nb. Alternatively, the sensing transistor M3 may be turned on when the sensing signal is supplied to the i-th second scan line SSi to measure a current flowing through the light emitting element OLED.

The light emitting element OLED may include a first electrode (e.g., an anode) connected to the second electrode of the driving transistor M1 and a second electrode (e.g., a cathode) connected to the second power ELVSS. The light emitting element OLED may generate light corresponding to the amount of current supplied from the driving transistor M1.

In FIG. 2, the first electrode of the transistors M1 to M3 may be set to one of the source electrode and the drain electrode, and the second electrode of the transistors M1 to M3 may be set to a different electrode from the first electrode, e.g., the other of the source electrode and the drain electrode. For example, when the first electrode is set to the source electrode, the second electrode may be set to the drain electrode.

In addition, the transistors M1 to M3 may be NMOS transistors as shown in FIG. 2.

While sensing a mobility of the driving transistor M1, an activated scan signal is supplied to the i-th first scan line SCi and an activated sensing signal is supplied to the i-th second scan line SSi. However, the driving transistor M1 needs to be turned off and the sensing transistor M3 needs to be turned on to sense the current flowing through the light emitting element OLED to obtain degradation information. In other words, while sensing the current flowing through the light emitting element OLED, a deactivated signal must be applied to the i-th first scan line SCi and an activated signal must be applied to the i-th second scan line SSi. Therefore, it is necessary to separately supply the scan signal supplied to the i-th first scan line SCi and the sensing signal supplied to the i-th second scan line SSi.

Figure 3:
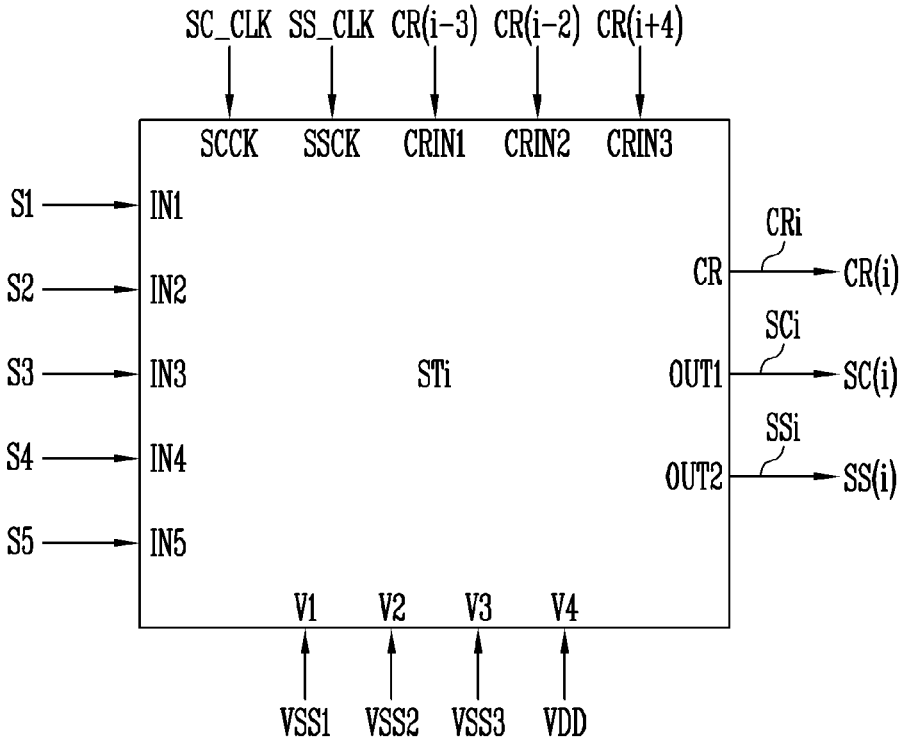
FIG. 3 is a drawing schematically showing a stage in the display device shown in FIG. 1 according to an exemplary embodiment of the inventive concept.

FIG. 3 is a drawing schematically showing a stage in the display device shown in FIG. 1 according to an exemplary embodiment of the inventive concept. FIG. 3 shows only an i-th stage STi for better understanding and ease of description.

The i-th stage STi outputs the scan signal SC (i) to the first scan line SCi in response to input signals, and outputs the sensing signal SS (i) to the second scan line SSi. The i-th stage STi may include first to fifth input terminals IN1 to IN5, a scan clock terminal SCCK, a sensing clock terminal SSCK, first to third carry input terminals CRIN1 to CRIN3, and first to fourth power terminals V1 to V4. In addition, the i-th stage STi may include a carry output terminal CR, a first output terminal OUT1, and a second output terminal OUT2.

The first to fifth input terminals IN1 to IN5 may receive first to fifth control signals S1 to S5, respectively. The first to fifth control signals S1 to S5 may be global signals supplied from the timing controller 240 to control an output of the scan signal SC (i) and the sensing signal SS (i).

In exemplary embodiments of the inventive concept, a gate-on level of the first to fifth control signals S1 to S5 may be a voltage capable of turning on transistors provided in the i-th stage STi, and for example, the gate-on level of the first to fifth control signals S1 to S5 may be set to about 25V when the transistors provided in the i-th stage STi are n-type transistors. On the contrary, a gate-off level of the first to fifth control signals S1 to S5 may be a voltage capable of turning off transistors provided in the i-th stage STi, and for example, the gate-off level of the first to fifth control signals S1 to S5 may be set to about −6V when the transistors provided in the i-th stage STi are n-type transistors. However, the inventive concept is not limited thereto.

In an exemplary embodiment of the inventive concept, the third control signal S3 and the fourth control signal S4 may be alternately supplied to the stages. For example, when the third control signal S3 is supplied to the i-th stage STi, the fourth control signal S4 may be supplied to an i+1-th stage STi+1. In an exemplary embodiment of the inventive concept, the fourth input terminal IN4 of the i-th stage STi may be deactivated or may not be provided, and the third input terminal IN3 of the i+1-th stage STi+1 may be deactivated or may not be provided.

The scan clock terminal SCCK may receive one of the first to sixth scan clock signals SC_CLK1 to SC_CLK6. The first to sixth scan clock signals SC_CLK1 to SC_CLK6 may have a logic high level and a logic low level. Here, the logic high level corresponds to the gate-on voltage, and the logic low level corresponds to the gate-off voltage. For example, the logic high level may be about 25V, and the logic low level may be about −6V.

In an exemplary embodiment of the inventive concept, a period of the gate-on voltage of the first to sixth scan clock signals SC_CLK1 to SC_CLK6 may be about two horizontal periods 2H. In addition, the period of the gate-on voltage of an i-th scan clock signal and an i+1-th scan clock signal may be overlapped for about one horizontal period 1H. However, this is only an example, and the period of the gate-on voltage of the first to sixth scan clock signals SC_CLK1 to SC_CLK6 may be set shorter than the two horizontal periods 2H. In addition, the number of the scan clock signals supplied to one stage is not limited thereto.

The scan clock signal input to the scan clock terminal SCCK may have a gate-on voltage synchronized to the scan signal SC (i). For example, the scan clock signal input to the scan clock terminal SCCK may have a gate-on voltage when sensing the mobility and threshold voltage of the driving transistor during a sensing period in a frame.

The sensing clock terminal SSCK may receive one of the first to sixth sensing clock signals SS_CLK1 to SS_CLK6. The first to sixth sensing clock signals SS_CLK1 to SS_CLK6 may have a logic high level and a logic low level. Here, the logic high level may correspond to a gate-on voltage, and the logic low level corresponds to a gate-off voltage. For example, the logic high level may be about 25V, and the logic low level may be about −6V.

In an exemplary embodiment of the inventive concept, a period of the gate-on voltage of the first to sixth sensing clock signals SS_CLK1 to SS_CLK6 may be about two horizontal periods 2H. In addition, a period of the gate-on voltage of an i-th sensing clock signal and an i+1-th sensing clock signal may be overlapped for about one horizontal period 1H. However, this is only an example, and the period of the gate-on voltage of the first to sixth sensing clock signals SS_CLK1 to SS_CLK6 may be set shorter than two horizontal periods 2H. In addition, the number of the sensing clock signals supplied to one stage is not limited thereto.

The sensing clock signal input to the sensing clock terminal SSCK may have a gate-on voltage synchronized to the sensing signal SS (i). For example, the sensing clock signal input to the sensing clock terminal SSCK may maintain a gate-on voltage during a sensing period in a frame. In an exemplary embodiment of the inventive concept, the sensing clock signal SS_CLK input to the sensing clock terminal SSCK during a display period in a frame may have a waveform synchronized with a scan clock signal SC_CLK input to the scan clock terminal SCCK.

The first to third carry input terminals CRIN1 to CRIN3 receive a carry signal output from a previous stage and/or a next stage. For example, the first carry input terminal CRIN1 may receive a carry signal CR (i−3) of an i−3-th stage, the second carry input terminal CRIN2 may receive a carry signal CR (i−2) of an i−2-th stage, and the third carry input terminal CRIN3 may receive a carry signal CR (i+4) of an i+4-th stage.

The first power terminal V1 may receive a voltage of a first power VSS1, the second power terminal V2 may receive a voltage of a second power VSS2, the third power terminal V3 may receive a voltage of a third power VSS3, and the fourth power terminal V4 may receive a voltage of a fourth power VDD. The fourth power VDD may be set to a gate-on voltage, and the first to third power VSS1 to VSS3 may be set to a level lower than the voltage of the fourth power VDD. For example, the fourth power VDD may be set to about 25V and the first to third power VSS1 to VSS3 may be set to about −6V. In exemplary embodiments of the inventive concept, the first to third power VSS1 to VSS3 may be set to the same level or different levels.

The carry output terminal CR may output a carry signal CR (i). The first output terminal OUT1 may output the scan signal SC (i). The second output terminal OUT2 may output the sensing signal SS (i).

The i-th stage STi according to an exemplary embodiment of the inventive concept does not receive a clock signal supplied by the timing controller 240 as compared with a conventional stage. Instead, the i-th stage STi according to an exemplary embodiment of the inventive concept uses a scan clock signal instead of the clock signal and is configured to output the carry signal CR (i) based on the scan clock signal. The detailed structure of the i-th stage STi according to an exemplary embodiment of the inventive concept will be described in detail below with reference to the drawings.

Figure 4:
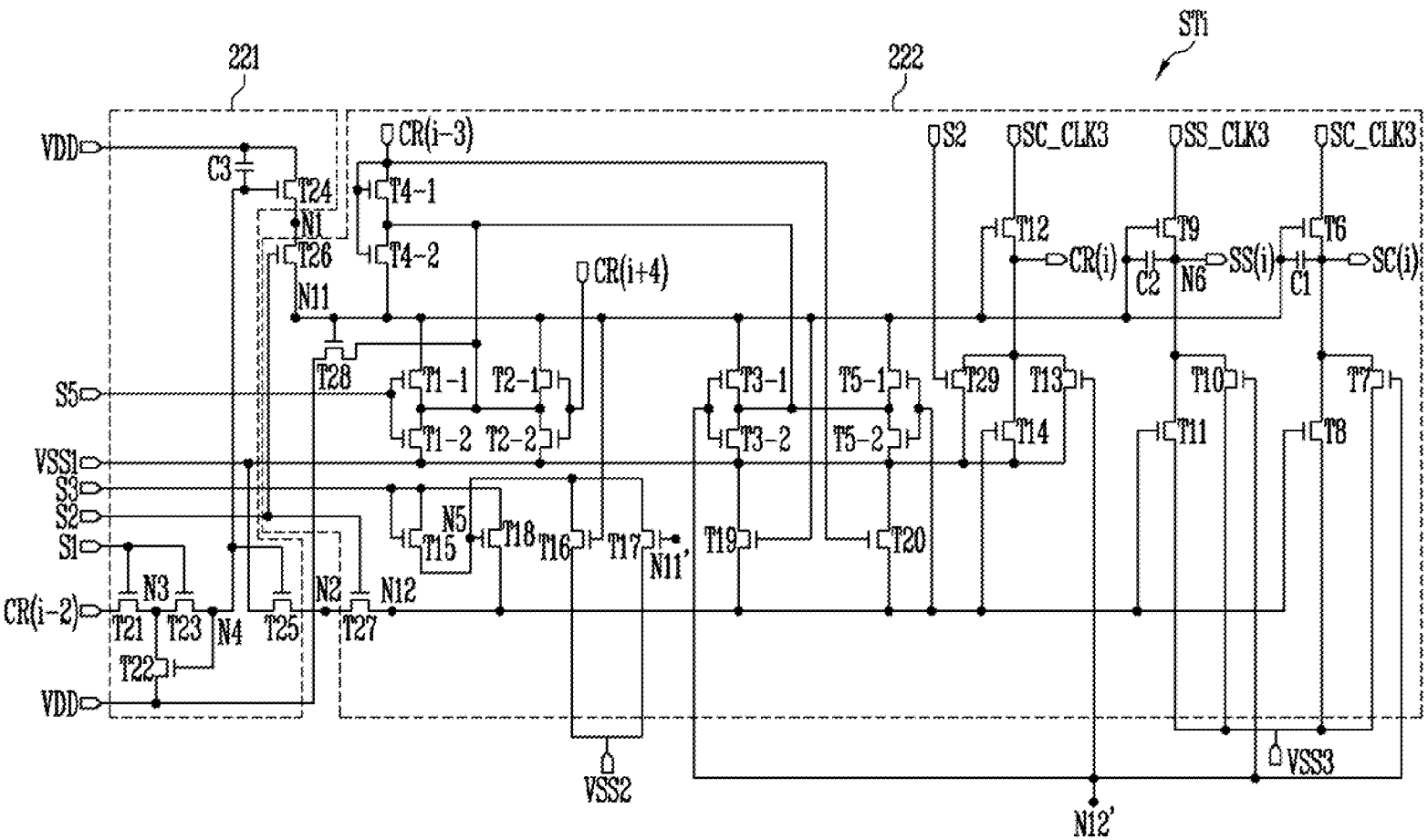
FIG. 4 is a circuit diagram showing the stage shown in FIG. 3 according to an exemplary embodiment of the inventive concept.

FIG. 4 is a circuit diagram showing the stage shown in FIG. 3 according to an exemplary embodiment of the inventive concept. FIG. 4 shows only one stage STi is for better understanding and ease of description. In addition, when it is stated that a certain signal is supplied, it may mean that a gate-on voltage (e.g., a high voltage) is supplied, and when it is stated that the certain signal is not supplied, it may mean that a gate-off voltage (e.g., a low voltage) is supplied.

Referring to FIGS. 3 and 4, the i-th stage STi according to an exemplary embodiment of the inventive concept may include an input unit 221 and an output buffer 222. The input unit 221 may include twenty-first to twenty-fifth transistors T21 to T25 and a third capacitor C3. In addition, the output buffer 222 includes first to twentieth transistors T1 to T20, twenty-sixth to twenty-ninth transistors T26 to T29, and first and second capacitors C1 and C2.

The configuration of the input unit 221 will be first described as follows.

A first electrode of the third capacitor C3 is connected to the fourth power terminal V4 to which the fourth power VDD is input, and a second electrode thereof is connected to a gate electrode (e.g., a fourth node N4) of the twenty-fourth transistor T24. The third capacitor C3 stores a voltage corresponding to the gate electrode of twenty-fourth transistor T24. Here, the fourth power VDD may be set to, for example a gate-on voltage.

The twenty-first transistor T21 is connected between the second carry input terminal CRIN2 to which the i−2-th carry signal CR (i−2) is input and the third node N3. A gate electrode of twenty-first transistor T21 is connected to the first input terminal IN1 to which the first control signal S1 is input. The twenty-first transistor T21 may be turned on when the first control signal S1 is supplied to supply a voltage corresponding to the i−2-th carry signal CR (i−2) to the third node N3.

The twenty-second transistor T22 is connected between the third node N3 and the fourth power terminal V4 to which the fourth power VDD is input. A gate electrode of the twenty-second transistor T22 is connected to the fourth node N4. The twenty-second transistor T22 is turned on or off in response to a voltage of the fourth node N4.

The twenty-third transistor T23 is connected between the third node N3 and the fourth node N4. A gate electrode of twenty-third transistor T23 is connected to the first input terminal IN1 to which the first control signal S1 is input. The twenty-third transistor T23 is turned on when the first control signal S1 is supplied to supply a voltage of the third node N3 to the fourth node N4.

The twenty-fourth transistor T24 is connected between the fourth power terminal V4 to which the fourth power VDD is input and the first node N1. A gate electrode of the twenty-fourth transistor T24 is connected to the fourth node N4. The twenty-fourth transistor T24 is turned on or off in response to a voltage of the fourth node N4. When the twenty-fourth transistor T24 is turned on, a high voltage of the fourth power VDD is supplied to the first node N1.

The twenty-fifth transistor T25 is connected between the first power terminal V1 to which the first power VSS1 is input and a second node N2. A gate electrode of the twenty-fifth transistor T25 is connected to the fourth node N4. The twenty-fifth transistor T25 is turned on or off in response to a voltage of the fourth node N4. When the twenty-fifth transistor T25 is turned on, a low voltage of the first power VSS1 is supplied to the second node N2. Here, the first power VSS1 may be set to a voltage lower than the fourth power VDD, for example, a gate-off voltage.

The output buffer 222 is connected to the input unit 221 through the first node N1 and the second node N2.

The first transistor T1 may include a 1-1-th transistor T1-1 and a 1-2-th transistor T1-2. The 1-1-th transistor T1-1 and the 1-2-th transistor T1-2 are connected in series between an eleventh node N11 and the first power terminal V1 to which the first power VSS1 is input. Gate electrodes of the 1-1-th transistor T1-1 and 1-2-th transistor T1-2 are connected to the fifth input terminal IN5 to which the fifth control signal S5 is input. The 1-1-th transistor T1-1 and 1-2-th transistor T1-2 may be turned on when the fifth control signal S5 is supplied to set a voltage of the eleventh node N11 to a voltage of the first power VSS1.

The second transistor T2 may include a 2-1-th transistor T2-1 and a 2-2-th transistor T2-2. The 2-1-th transistor T2-1 and 2-2-th transistor T2-2 are connected in series between the eleventh node N11 and the first power terminal V1 to which the first power VSS1 is input. Gate electrodes of the 2-1-th transistor T2-1 and 2-2-th transistor T2-2 are connected to the third carry input terminal CRIN3 to which the i+4-th carry signal CR (i+4) is input. The 2-1-th transistor T2-1 and 2-2-th transistor T2-2 may be turned on when the i+4-th carry signal CR (i+4) is supplied to set a voltage of the eleventh node N11 to a voltage of the first power VSS1.

The third transistor T3 may include a 3-1-th transistor T3-1 and a 3-2-th transistor T3-2. The 3-1-th transistor T3-1 and 3-2-th transistor T3-2 are connected in series between the eleventh node N11 and the first power terminal V1 to which the first power VSS1 is input. Gate electrodes of the 3-1-th transistor T3-1 and 3-2-th transistor are connected to a twelfth node N12' of the next stage. The 3-1-th transistor T3-1 and 3-2-th transistor T3-2 are turned on in response to a voltage of the twelfth node N12' of the next stage to supply a voltage of the first power VSS1 to the eleventh node N11.

The fourth transistor T4 may include a 4-1-th transistor T4-1 and a 4-2-th transistor T4-2. The 4-1-th transistor T4-1 and 4-2-th transistor T4-2 are connected in series between the eleventh node N11 and the first carry input terminal CRIN1 to which the i−3-th carry signal CR (i−3) is input. Gate electrodes of the 4-1-th transistor T4-1 and 4-2-th transistor T4-2 are connected to the first carry input terminal CRIN1. The 4-1-th transistor T4-1 and 4-2-th transistor T4-2 are turned on when the i−3-th carry signal CR (i−3) is supplied to supply the i−3-th carry signal CR (i−3) to the eleventh node N11.

The fifth transistor T5 may include a 5-1-th transistor T5-1 and a 5-2-th transistor T5-2. The 5-1-th transistor T5-1 and 5-2-th transistor T5-2 are connected in series between the eleventh node N11 and the first power terminal V1 to which the first power VSS1 is input. Gate electrodes of the 5-1-th transistor T5-1 and 5-2-th transistor T5-2 are connected to a twelfth node N12. The 5-1-th transistor T5-1 and 5-2-th transistor T5-2 are turned on or off in response to a voltage of the twelfth node N12. When the 5-1-th transistor T5-1 and 5-2-th transistor T5-2 are turned on, a voltage of the first power VSS1 may be supplied to the eleventh node N11.

The sixth transistor T6 is connected between the scan clock terminal SCCK to which the scan clock signal SC_CLK (e.g., the third scan clock signal SC_CLK3) is input and the first output terminal OUT1 which outputs the scan signal SC (i). A gate electrode of the sixth transistor T6 is connected to the eleventh node N11. The sixth transistor T6 may be turned on when the eleventh node N11 is set to a high voltage to output the scan clock signal SC_CLK to the first output terminal OUT1.

The seventh transistor T7 is connected between the first output terminal OUT1 and the third power terminal V3 receiving the third power VSS3. A gate electrode of the seventh transistor T7 is connected to the twelfth node N12' of the next stage. The seventh transistor T7 may be turned on in response to a voltage of the twelfth node N12' of the next stage to set a voltage of the first output terminal OUT1 to a voltage of the third power VSS3. Here, the third power VSS3 may be set to a lower voltage than the first power VSS1.

The eighth transistor T8 is connected between the first output terminal OUT1 and the third power terminal V3 receiving the third power VSS3. A gate electrode of the eighth transistor T8 is connected to the twelfth node N12. The eighth transistor T8 may be turned on or off in response to a voltage of the twelfth node N12. As the eighth transistor T8 is turned on, a low voltage of the third power VSS3 may be output to the first output terminal OUT1.

The first capacitor C1 is connected between the first output terminal OUT1 and the eleventh node N11.

The ninth transistor T9 is connected between the sensing clock terminal SSCK receiving the sensing clock signal SS_CLK (e.g., the third sensing clock signal SS_CLK3) and the second output terminal OUT2 outputting the sensing signal SS (i). A gate electrode of the ninth transistor T9 is connected to the eleventh node N11. The ninth transistor T9 may be turned on when the eleventh node N11 is set to a high voltage to output the sensing clock signal SS_CLK to the second output terminal OUT2.

The tenth transistor T10 is connected between the second output terminal OUT2 and the third power terminal V3 receiving the third power VSS3. A gate electrode of the tenth transistor T10 is connected to the twelfth node N12' of the next stage. The tenth transistor T10 may be turned on in response to a voltage of the twelfth node N12' of the next stage to set a voltage of the second output terminal OUT2 to a voltage of the third power VSS3.

The eleventh transistor T11 is connected between the second output terminal OUT2 and the third power terminal V3 receiving the third power VSS3. A gate electrode of the eleventh transistor T11 is connected to the twelfth node N12. The eleventh transistor T11 may be turned on or off in response to a voltage of the twelfth node N12. As the eleventh transistor T11 is turned on, a low voltage of the third power VSS3 may be output to the second output terminal OUT2.

The second capacitor C2 is connected between the second output terminal OUT2 and the eleventh node N11.

The twelfth transistor T12 is connected between the scan clock terminal SCCK to which the scan clock signal SC_CLK (e.g., the third scan clock signal SC_CLK3) is input and the carry output terminal CR which outputs the carry signal CR (i). A gate electrode of the twelfth transistor T12 is connected to the eleventh node N11. The twelfth transistor T12 may be turned on when the eleventh node N11 is set to a high voltage to output the scan clock signal SC_CLK to the carry output terminal CR.

The thirteenth transistor T13 is connected between the carry output terminal CR and the first power terminal V1 to which the first power VSS1 is input. A gate electrode of thirteenth transistor T13 may be connected to the twelfth node N12' of the next stage. The thirteenth transistor T13 may be turned on in response to a voltage of the twelfth node N12' of the next stage to set a voltage of the carry output terminal CR to a voltage of the first power VSS1.

The fourteenth transistor T14 is connected between the carry output terminal CR and the first power terminal V1 to which the first power VSS1 is input. A gate electrode of the fourteenth transistor T14 is connected to the twelfth node N12. The fourteenth transistor T14 may be turned on or off in response to a voltage of the twelfth node N12. As the fourteenth transistor T14 is turned on, a low voltage of the first power VSS1 may be output to the carry output terminal CR.

The twenty-ninth transistor T29 is connected between the carry output terminal CR and the first power terminal V1 to which the first power VSS1 is input. A gate electrode of twenty-ninth transistor T29 is connected to the second input terminal IN2 to which the second control signal S2 is input. The twenty-ninth transistor T29 may be turned on when the second control signal S2 is input to maintain a voltage of the carry output terminal CR at a low voltage of the first power VSS1.

The fifteenth transistor T15 is connected between the third input terminal IN3 receiving the third control signal S3 and a gate electrode (e.g., fifth node N5) of the eighteenth transistor T18. A gate electrode of the fifteenth transistor T15 is connected to the third input terminal IN3. The fifteenth transistor T15 is connected in diode form when the third control signal S3 is supplied to supply the third control signal S3 to the fifth node N5.

The sixteenth transistor T16 is connected between the fifth node N5 and the second power terminal V2 to which the second power VSS2 is input. A gate electrode of the sixteenth transistor T16 is connected to the eleventh node N11. The sixteenth transistor T16 may be turned on when the eleventh node N11 is set to a high voltage to supply a voltage of the second power VSS2 to the fifth node N5. Here, the second power VSS2 may be set to a lower voltage than the first power VSS1 and a higher voltage than the third power VSS3.

The seventeenth transistor T17 is connected between the fifth node N5 and the second power terminal V2 to which the second power VSS2 is input. A gate electrode of the seventeenth transistor T17 is connected to an eleventh node N11' of the next stage. The seventeenth transistor T17 is turned on or off in response to a voltage of the eleventh node N11' of the next stage.

The eighteenth transistor T18 is connected between the third input terminal IN3 to which the third control signal S3 is input and the twelfth node N12. A gate electrode of eighteenth transistor T18 is connected to the fifth node N5. The eighteenth transistor T18 is turned on or off in response to a voltage of the fifth node N5. As the eighteenth transistor T18 is turned on, a voltage of the third control signal S3 may be supplied to the twelfth node N12.

The nineteenth transistor T19 is connected between the twelfth node N12 and the first power terminal V1 to which the first power VSS1 is input. A gate electrode of nineteenth transistor T19 is connected to the eleventh node N11. The nineteenth transistor T19 may be turned on when a high voltage is applied to the eleventh node N11 to set a voltage of the twelfth node N12 to a low voltage of the first power VSS1.

The twentieth transistor T20 is connected between the twelfth node N12 and the first power terminal V1 to which the first power VSS1 is input. A gate electrode of the twentieth transistor T20 is connected to the first carry input terminal CRIN1 to which the i−3-th carry signal CR (i−3) is input. The twentieth transistor T20 may be turned on when the i−3-th carry signal CR (i−3) is supplied to set a voltage of the twelfth node N12 to a low voltage of the first power VSS1.

The twenty-sixth transistor T26 is connected between the first node N1 and the eleventh node N11. A gate electrode of twenty-sixth transistor T26 is connected to the second input terminal IN2 to which the second control signal S2 is input. The twenty-sixth transistor T26 may be turned on when the second control signal S2 is supplied to supply a voltage of the first node N1 to the eleventh node N11.

The twenty-seventh transistor T27 is connected between the second node N2 and the twelfth node N12. A gate electrode of the twenty-seventh transistor T27 is connected to the second input terminal IN2 to which the second control signal S2 is input. The twenty-seventh transistor T27 may be turned on when the second control signal S2 is supplied to supply a voltage of the second node N2 to the twelfth node N12.

One end of the twenty-eighth transistor T28 is connected to a common electrode of the 1-1-th transistor T1-1 and the 1-2-th transistor T1-2, a common electrode of the 2-1-th transistor T2-1 and the 2-2-th transistor T2-2, a common electrode of the 3-1-th transistor T3-1 and the 3-2-th transistor T3-2, a common electrode of the 4-1-th transistor T4-1 and the 4-2-th transistor T4-2, and a common electrode of the 5-1-th transistor T5-1 and the 5-2-th transistor T5-2. The other end of the twenty-second transistor T28 is connected to the fourth power terminal V4 to which the fourth power VDD is input. A gate electrode of the twenty-eighth transistor T28 is connected to the eleventh node N11. The twenty-eighth transistor T28 is turned on or off in response to a voltage of the eleventh node N11.

Figure 5:
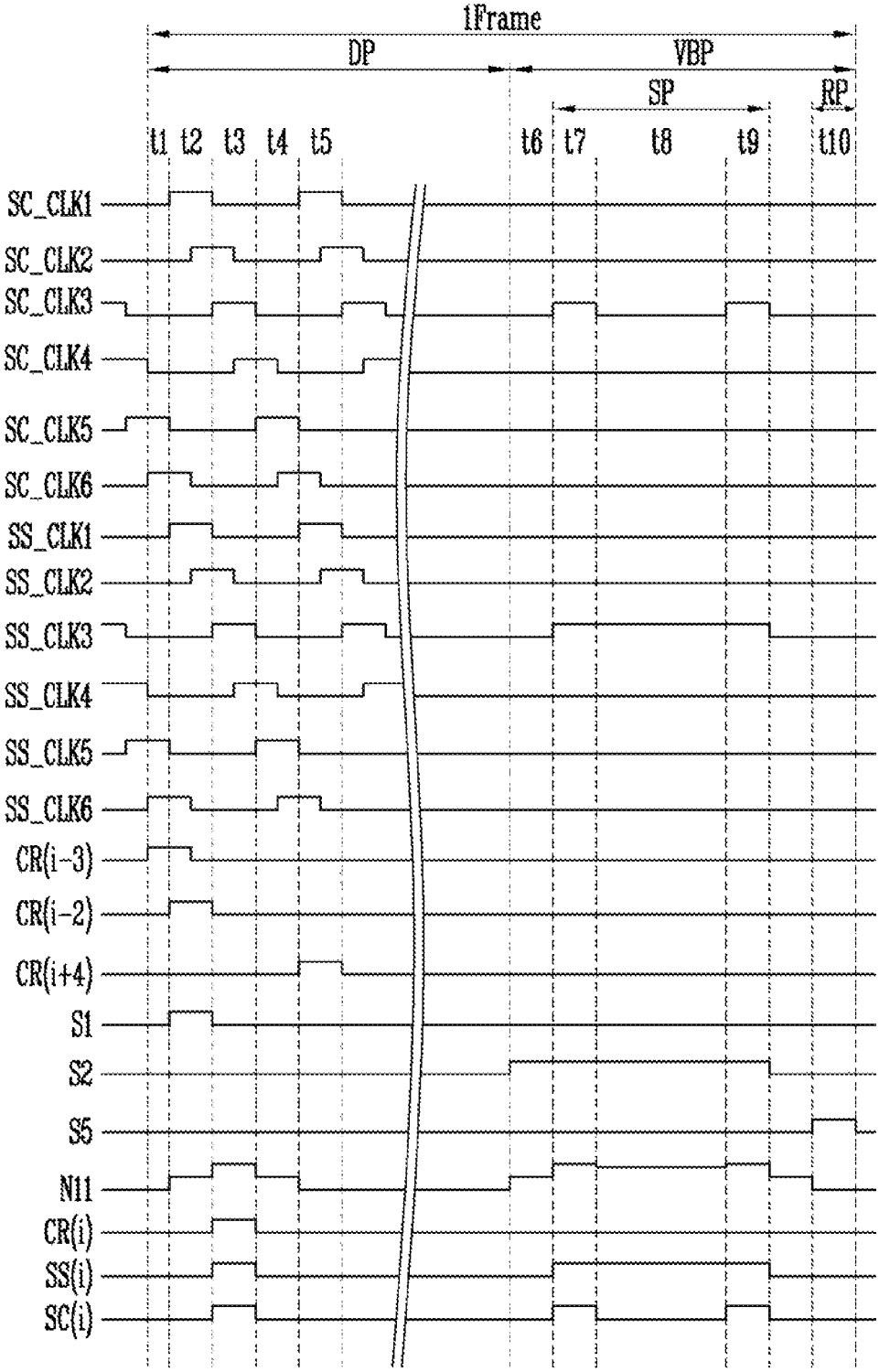
FIG. 5 is a waveform diagram showing a driving method of the stage shown in FIG. 4 according to an exemplary embodiment of the inventive concept.

FIG. 5 is a waveform diagram showing a driving method of the stage shown in FIG. 4 according to an exemplary embodiment of the inventive concept. FIG. 5 shows an exemplary embodiment in which sensing is performed for an i-th pixel column during the sensing period. Here, the i-th pixel column is connected to the i-th stage STi receiving the third scan clock signal SC_CLK3 and the third sensing clock signal SS_CLK3. The i-th stage STi may be configured to receive the third control signal S3 and not to receive the fourth control signal S4.

In addition, referring to FIG. 5, one frame period 1Frame may include a display period DP and a vertical blanking period VBP, and the vertical blanking period VBP may include a sensing period SP and a reset period RP.

Referring to FIGS. 4 and 5, as the i−3-th carry signal CR (i−3) is supplied in synchronization with the sixth scan clock signal SC_CLK6 during a first period t1, the 4-1-th and 4-2-th transistors T4-1 and T4-2 may be turned on. Then, a high voltage of the i−3-th carry signal CR (i−3) may be supplied to the eleventh node N11, and the eleventh node N11 may be set to a high voltage.

When the eleventh node N11 is set to a high voltage, the twelfth transistor T12, ninth transistor T9, and sixth transistor T6 are turned on, but the third scan clock signal SC_CLK3 and the third sensing clock signal SS_CLK3 are not supplied during the first period t1, so that the carry signal CR (i), scan signal SC (i), and sensing signal SS (i) are not output.

In addition, as the i−3-th carry signal CR (i−3) is supplied during the first period t1, the twentieth transistor T20 may be turned on. Then, a low voltage of the first power VSS1 may be supplied to the twelfth node N12, and the twelfth node N12 may be set to a low voltage.

During the second period t2, the i−2-th carry signal CR (i−2) and the first control signal S1 are supplied to the input unit 221 in synchronization with the first scan clock signal SC_CLK1. As the first control signal S1 is supplied, the twenty-first transistor T21 and the twenty-third transistor T23 of the i-th stage STi are turned on. When the twenty-first transistor T21 and the twenty-third transistor T23 are turned on, a high voltage of the i−2-th carry signal CR (i−2) is supplied to the fourth node N4. When a high voltage is supplied to the fourth node N4, the twenty-second transistor T22, the twenty-fourth transistor T24, and the twenty-fifth transistor T25 are turned on.

When the twenty-second transistor T22 is turned on, a high voltage of the fourth power VDD is supplied to the third node N3 so that a high voltage of the third node N3 may be stably maintained.

When the twenty-fourth transistor T24 is turned on, a high voltage of the fourth power VDD is supplied to the first node N1 so that the first node N1 is set to a high voltage. At this time, the third capacitor C3 stores a high voltage of the fourth node N4.

When the twenty-fifth transistor T25 is turned on, a low voltage of the first power VSS1 is supplied to the second node N2 so that the second node N2 is set to a low voltage.

The first control signal S1 is selectively supplied to a stage connected to a pixel column to be sensed in the next sensing period SP, so that the voltage of the first node N1 and the voltage of the second node N2 may be set to the high voltage and the low voltage, respectively.

On the other hand, since the second control signal S2 is not supplied during the second period t2, the twenty-sixth transistor T26 and the twenty-seventh transistor T27 maintain a turn-off state, and a voltage control of the first node N1 and the second node N2 does not affect the voltage of the eleventh node N11 and twelfth node N12. Thus, during the second period t2, the eleventh node N11 and the twelfth node N12 may maintain a voltage of the previous period (e.g., the eleventh node N11 is a high voltage and the twelfth node N12 is a low voltage).

The third scan clock signal SC_CLK3 and the third sensing clock signal SS_CLK3 are supplied to the i-th stage STi during the third period t3. At this time, as the eleventh node N11 is maintained at a high voltage, the sixth transistor T6, the ninth transistor T9, and the twelfth transistor T12 maintain a turn-on state, so the carry signal CR (i), the scan signal SC (i), and the sensing signal SS (i) are output.

During the third period t3, a voltage of the eleventh node N11 may be set to a higher voltage than the first period t1 by coupling the first capacitor C1 and second capacitor C2.

When a supply of the third scan clock signal SC_CLK3 and the third sensing clock signal SS_CLK3 is stopped during the fourth period t4, an output of the carry signal CR (i), the scan signal SC (i), and the sensing signal SS (i) may be stopped and the voltage of the eleventh node N11 may return to the voltage at the first period t1.

As the i+4-th carry signal CR (i+4) is supplied in synchronization with the first scan clock signal SC_CLK1 during the fifth period t5, the 2-1-th and 2-2-th transistors T2-1 and T2-2 may be turned on. Then, the low voltage of the first power VSS1 may be supplied to the eleventh node N11, and the eleventh node NI1 may be set to the low voltage.

During the sixth period t6, the second control signal S2 is supplied to the i-th stage STi. The twenty-sixth transistor T26, the twenty-seventh transistor T27, and the twenty-ninth transistor T29 are turned on as the second control signal S2 is supplied. When the twenty-sixth transistor T26 is turned on, the high voltage of the first node N1 is supplied to the eleventh node N11. When the eleventh node N11 is set to the high voltage, the ninth transistor T9, the sixth transistor T6, and the twelfth transistor T12 are turned on. Since the third scan clock signal SC_CLK3 and the third sensing clock signal SS_CLK3 are not supplied during the sixth period t6, the carry signal CR (i), the scan signal SC (i), and the sensing signal SS (i) are not output. In addition, when the twenty-seventh transistor T27 is turned on, the low voltage of the second node N2 is supplied to the twelfth node N12.

Only the stage receiving the first control signal S1 during the second period t2 may set the first node N1 to the high voltage and the eleventh node N11 to the high voltage during the sixth period t6.

The second control signal S2, the third scan clock signal SC_CLK3, and the third sensing clock signal SS_CLK3 are supplied to the i-th stage STi during the seventh period t7. At this time, since the eleventh node NI1 is set to the high voltage, the sixth transistor T6 and the ninth transistor T9 are maintained in the turn-on state, and the scan signal SC (i) and the sensing signal SS (i) are output. Then, the characteristics (e.g., threshold voltage, mobility, etc.) of the driving transistor provided in the pixel PX receiving the scan signal SC (i) and the sensing signal SS (i) may be measured.

At this time, the twelfth transistor T12 also maintains the turn-on state, but the low voltage of the first power VSS1 is supplied to the carry output terminal CR by the twenty-ninth transistor T29, which maintains the turn-on state by the supply of the second control signal S2, so that the carry signal CR (i) may stably maintain the low level state. In other words, the i-th stage STi according to an exemplary embodiment of the inventive concept may prevent unnecessary output of the carry signal by using the second control signal S2 that is continuously supplied during the sensing period SP to the twenty-ninth transistor T29 even if a circuit unit for controlling the carry signal output and a circuit unit for controlling the scan signal output use one clock signal (e.g., a scan clock signal). As a result, a stage according to an exemplary embodiment of the inventive concept does not have a separate clock signal for controlling the carry signal output, thus reducing lines for the clock signals.

The voltage of the eleventh node N11 during the seventh period t7 may be set to a higher voltage than that during the sixth period t6 by the coupling of the first capacitor C1 and the second capacitor C2.

During the eighth period t8, a supply of the third scan clock signal SC_CLK3 to the i-th stage STi is stopped. Then, an output of the scan signal SC (i) is stopped and a coupling of the first capacitor C1 is released, so the voltage of the eleventh node NI1 may be set to a somewhat lower voltage than that during the seventh period t7.

The characteristic of the organic light emitting diode OLED provided in the pixel PX may be measured during the eighth period t8.

During the ninth period t9, the third scan clock signal SC_CLK3 and the third sensing clock signal SS_CLK3 are supplied to the i-th stage STi, so the scan signal SC (i) and the sensing signal SS (i) are output.

In an exemplary embodiment of the inventive concept, during the ninth period t9, a data signal in the corresponding frame is supplied to the pixel PX so that the driving transistor may be initialized.

During the tenth period t10, the fifth control signal S5 is supplied to the i-th stage STi. Therefore, the 1-1-th and 1-2-th transistors T1-1 and T1-2 are turned on and the voltage of the eleventh node N11 is initialized to the low voltage of the first power VSS1.

Figure 6:
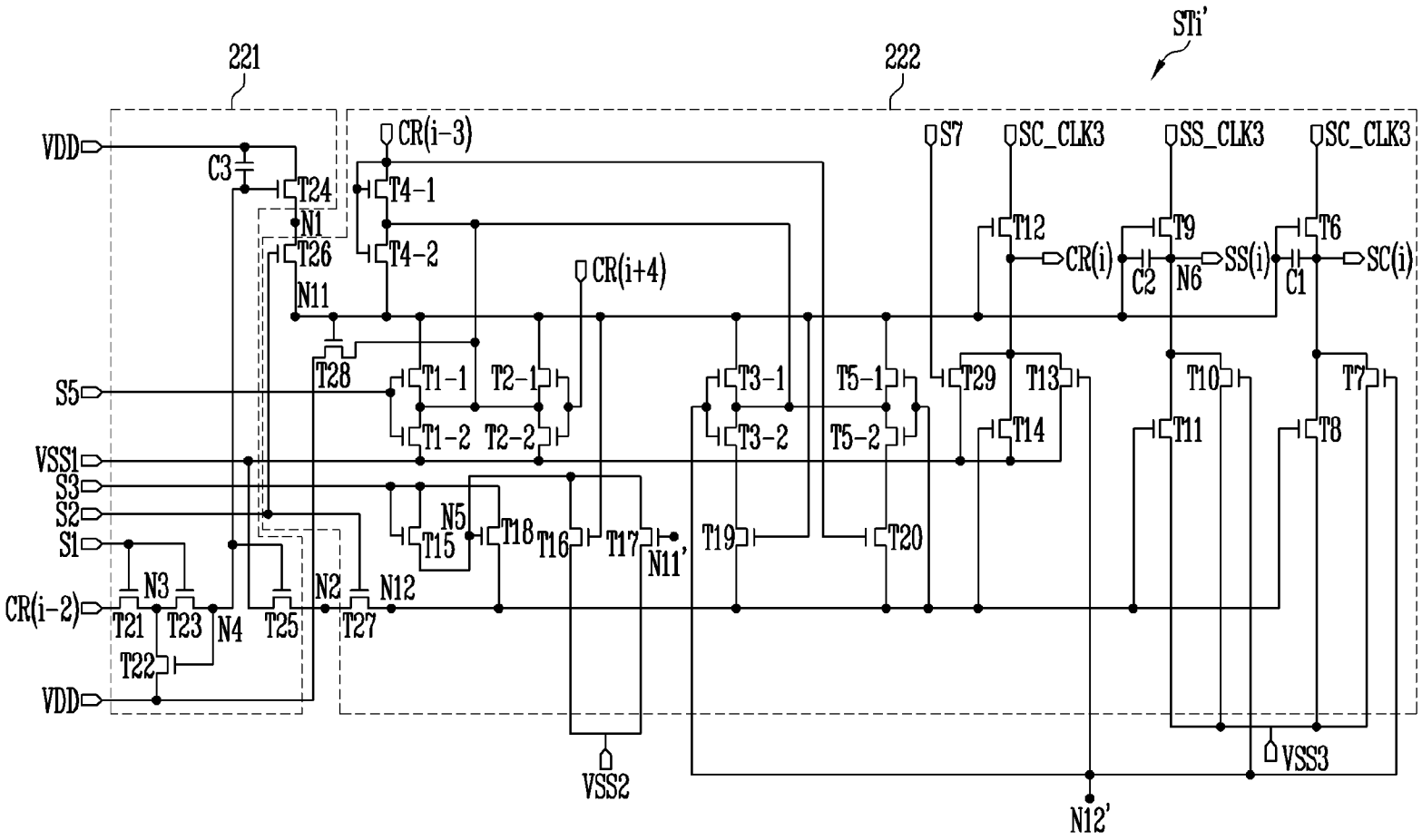
FIG. 6 is a circuit diagram showing the stage shown in FIG. 3 according to an exemplary embodiment of the inventive concept.

FIG. 6 is a circuit diagram showing the stage shown in FIG. 3 according to an exemplary embodiment of the inventive concept. FIG. 6 shows only one stage STi for better understanding and ease of description A stage STi' shown in FIG. 6 is substantially the same as the i-th stage STi shown in FIG. 4 except that a seventh control signal S7 is applied to a gate electrode of the twenty-ninth transistor T29 as compared with the i-th stage STi shown in FIG. 4. Therefore, a detailed description thereof will be omitted.

In the exemplary embodiment shown in FIG. 6, the i-th stage STi' may further include an input terminal for receiving the seventh control signal S7. The seventh control signal S7 is may be set to have a gate-on voltage of the same waveform as that of the second control signal S2 during the seventh period t7 to ninth period t9 shown in FIG. 5. In this exemplary embodiment, during the seventh period t7 to ninth period t9, the second control signal S2 is not supplied redundantly.

This exemplary embodiment further requires an additional line as compared with the i-th stage STi shown in FIG. 3, but does not use the clock signal unlike the conventional stage as discussed above. As a result, the total number of lines may be reduced.

Figure 7:
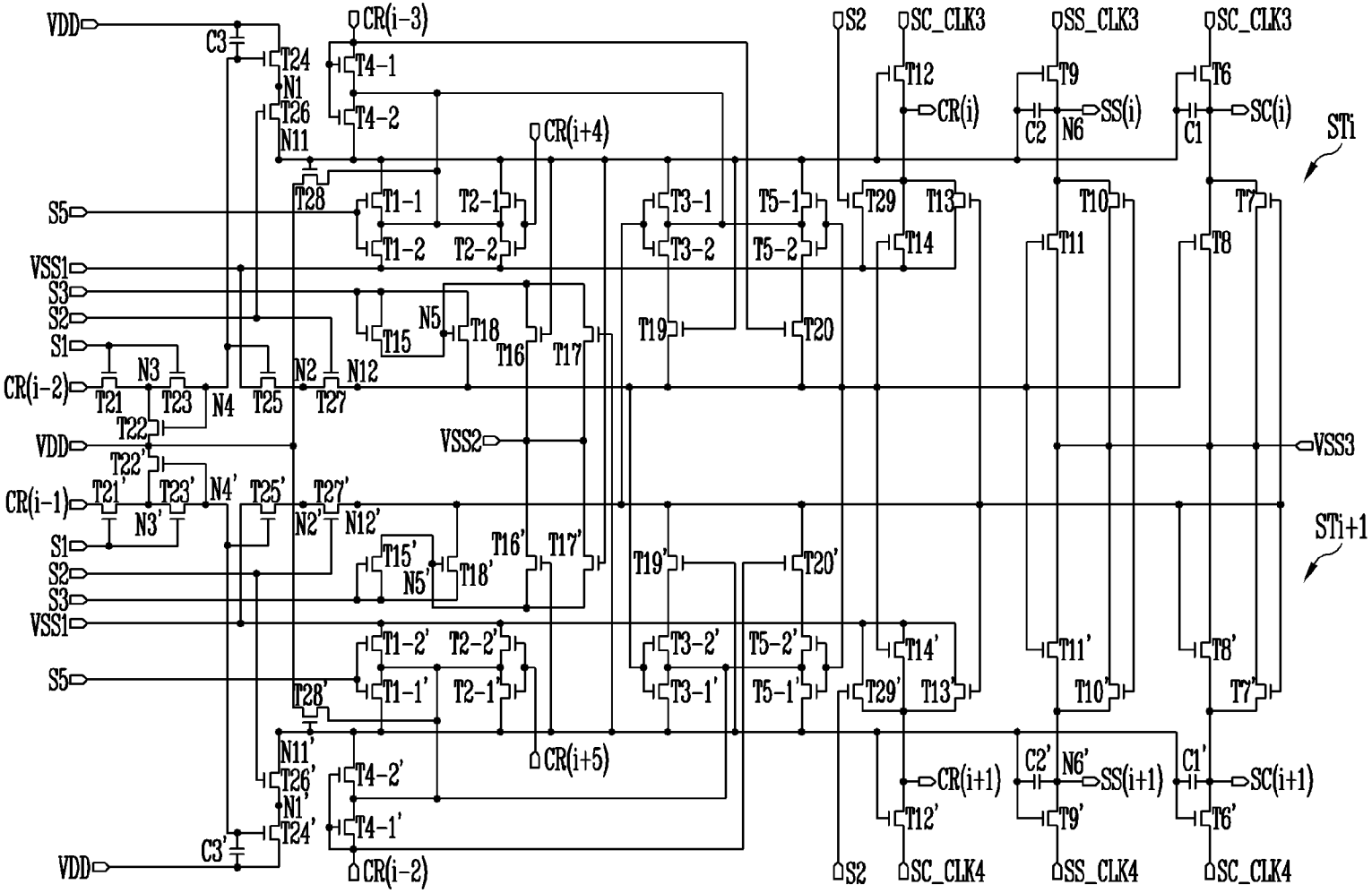
FIG. 7 is a circuit diagram showing stages according to an exemplary embodiment of the inventive concept.

FIG. 7 is a circuit diagram showing stages according to an exemplary embodiment of the inventive concept. More specifically, FIG. 7 shows a connection relation between i-th and i+i-th stages STi and STi+1 adjacent to each other. FIG. 7 shows two stages STi and STi+1 for better understanding and ease of description.

The i-th and i+i-th stages STi and STi+1 shown in FIG. 7 are substantially the same as the i-th stage STi shown in FIG. 4. Therefore, a detailed description thereof will be omitted.

Referring to FIG. 7, the i-th stage STi and the i+1-th stage STi+1 may be disposed in a top-to-bottom reversed form. In other words, the i+1-th stage STi+1 has the same structure as the i-th stage STi except that it is flipped. In this exemplary embodiment, the i-th stage STi and the i+1-th stage STi+1 may share lines adjacent to each other. For example, the i-th stage STi and the i+1-th stage STi+1 share a line of the fourth power VDD, a line of the second power VSS2, and a line of the third power VSS3 in FIG. 7.

According to the structure shown in FIG. 7, an entire area of the scan driver 210 may be reduced, and electrical problems such as crosstalk occurring between lines may be prevented or reduced.

As described above, a stage and a scan driver including the same according to exemplary embodiments of the inventive concept may be configured to share a clock signal for controlling a carry signal output and a clock signal for controlling a scan signal output, thus minimizing an area occupied by a clock signal line.

In addition, a stage and a scan driver including the same according to exemplary embodiments of the inventive concept may reduce the number of lines to minimize intersections between the lines and thus reduce defects such as crosstalk at the intersections between the lines.

While the inventive concept has been shown and described with reference to exemplary embodiments thereof, it will be apparent to those of ordinary skill in the art that various changes in form and details may be made thereto without departing from the spirit and scope of the inventive concept as set forth by the appended claims.

What is claimed is:

1. A stage connected to scan lines and configured to supply a scan signal and a sensing signal to the scan lines, the stage comprising:

an input unit connected to a first node and a second node, the input unit controlling a voltage of the first node and the second node in response to a first control signal and a previous carry signal, wherein an eleventh node and a twelfth node are electrically connected to the first node and the second node, respectively, in response to a second control signal; and an output buffer outputting a carry signal and the scan signal in response to a scan clock signal according to a voltage of the eleventh node and the twelfth node and outputting the sensing signal in response to a sensing clock signal, wherein the output buffer includes:

a first transistor configured to connect the eleventh node and a first power port in response to a fifth control signal, a second transistor configured to connect the eleventh node and the first power port in response to an i+4-th carry signal from a third carry input port, a third transistor configured to connect the eleventh node and the first power port in response to a voltage of a twelfth node of another stage adjacent to the stage, a fourth transistor configured to connect the eleventh node and a first carry input port to which an i-3-th carry signal is inputted in response to the i-3-th carry signal, and a fifth transistor configured to connect the eleventh node and the first power port in response to a voltage of the twelfth node.

2. The stage of claim 1, wherein the first transistor, the second transistor, the third transistor, and the fifth transistor are connected in parallel between the eleventh node and the first power port.

3. The stage of claim 1, wherein the output buffer further includes a twenty-sixth transistor configured to connect the first node to the eleventh node in response to the second control signal, and a twenty-seventh transistor configured to connect the second node to the twelfth node in response to the second control signal.

4. The stage of claim 1, wherein the output buffer further includes a sixteenth transistor configured to connect a fifth node and a second power port in response to the voltage of the eleventh node, and a seventeenth transistor configured to connect the fifth node and the second power port in response to a voltage of an eleventh node of the another stage adjacent to the stage.

5. The stage of claim 1, wherein the second control signal is input to the output buffer during a sensing period in a frame.

6. The stage of claim 5, wherein the scan clock signal and the sensing clock signal are input to the output buffer at least once while the second control signal is input during the sensing period.

7. The stage of claim 5, wherein the output buffer further includes:

a twelfth transistor connected between a scan clock port configured to receive the scan clock signal and a carry output port configured to output the carry signal, and including a gate electrode connected to the eleventh node; and a twenty-ninth transistor connected between the carry output port and the first power port configured to receive a first power, and including a gate electrode connected to a second input port configured to receive the second control signal.

8. The stage of claim 1, wherein:

the first transistor includes a 1-1th transistor and a 1-2th transistor in series between the eleventh node and the first power port, the second transistor includes a 2-1th transistor and a 2-2th transistor in series between the eleventh node and the first power port, the third transistor includes a 3-1th transistor and a 3-2th transistor in series between the eleventh node and the first power port, the fourth transistor includes a 4-1th transistor and a 4-2th transistor in series between the eleventh node and the first carry input port, and the fifth transistor includes a 5-1th transistor and a 5-2th transistor in series between the eleventh node and the first power port.

9. The stage of claim 1, wherein the output buffer further includes a nineteenth transistor configured to connect the twelfth node and the first power port in response to the voltage of the eleventh node.

10. The stage of claim 9, wherein the output buffer further includes a twentieth transistor configured to connect the twelfth node and the first power port in response to the first carry input port.

* * * * *